US007941075B2

(12) United States Patent
Shiraishi et al.

(10) Patent No.: US 7,941,075 B2
(45) Date of Patent: May 10, 2011

(54) IMAGE FORMING APPARATUS INCLUDING A CLEANER-LESS IMAGE CARRIER CLEANING SYSTEM

(75) Inventors: Emiko Shiraishi, Tokyo (JP); Shigekazu Enoki, Kawasaki (JP); Jun Yura, Yokohama (JP); Hirokatsu Suzuki, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 44 days.

(21) Appl. No.: 12/481,964

(22) Filed: Jun. 10, 2009

(65) Prior Publication Data

US 2009/0311006 A1 Dec. 17, 2009

(30) Foreign Application Priority Data

Jun. 11, 2008 (JP) ..... 2008-152445
Jul. 3, 2008 (JP) ..... 2008-174969

(51) Int. Cl.
*G03G 15/00* (2006.01)
*G03G 21/10* (2006.01)

(52) U.S. Cl. ..... 399/149; 399/129
(58) Field of Classification Search ..... 399/149, 399/150, 128, 129, 343, 174, 176
See application file for complete search history.

(56) References Cited

U.S. PATENT DOCUMENTS

| | | | | |
|---|---|---|---|---|
| 5,740,494 | A * | 4/1998 | Shoji et al. | 399/149 X |
| 5,778,285 | A * | 7/1998 | Nagahara et al. | 399/150 |
| 6,144,824 | A * | 11/2000 | Hashimoto et al. | 399/128 |
| 6,442,362 | B2 * | 8/2002 | Hirabayashi et al. | 399/149 |
| 7,110,699 | B2 * | 9/2006 | Yoshizawa et al. | 399/149 |
| 7,167,665 | B2 * | 1/2007 | Tomita et al. | 399/149 X |
| 2004/0086298 | A1 * | 5/2004 | Ojima et al. | 399/129 |
| 2006/0210310 | A1 * | 9/2006 | Takahashi et al. | 399/149 |
| 2007/0286643 | A1 * | 12/2007 | Kinokuni | 399/128 |

FOREIGN PATENT DOCUMENTS

| | | |
|---|---|---|
| JP | 2001-215799 | 8/2001 |
| JP | 2001-249525 | 9/2001 |
| JP | 3442574 B2 | 6/2003 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming apparatus includes an image carrier, a charging unit including a charge member that is disposed facing the image carrier across a gap therebetween and charges the image carrier by using electrical discharge caused by applying thereto a voltage including an alternating current component superimposed on a direct current component, a latent image forming unit, a developing unit to supply toner for developing the latent image formed on the image carrier into a toner image and to collect residual toner remaining on the image carrier, a transfer unit, and a toner spreading member to spread toner on the image carrier and disposed upstream from the charging unit in a direction of movement of the image carrier and downstream from the transfer unit in the direction of movement of the image carrier.

19 Claims, 5 Drawing Sheets

IMAGE FORMING APPARATUS INCLUDING A CLEANER-LESS IMAGE CARRIER CLEANING SYSTEM

CROSS-REFERENCE TO RELATED APPLICATIONS

The present invention claims priority pursuant to 35 U.S.C. §119 from Japanese Patent Application No. 2008-152445, filed on Jun. 11, 2008 in the Japan Patent Office, and Japanese Patent Application No. 2008-174969, filed on Jul. 3, 2008 in the Japan Patent Office, the contents and disclosures of each of which are hereby incorporated by reference herein in their entirety.

BACKGROUND OF THE INVENTION

1. Field of the Invention

Exemplary embodiments of the present invention generally relate to an image forming apparatus employing an electrophotographic technique and a cleaner-less system.

2. Discussion of the Related Art

In electrophotographic image forming apparatuses, after a toner image formed on a photoconductor serving as an image carrier is transferred onto a transfer member or a recording medium, some small amount of toner particles used to transfer the toner image at times remains on the surface of the photoconductor. Related-art electrophotographic image forming apparatuses have therefore included a cleaning unit for collecting and disposing of such residual toner. However, in response to recent demands for low-cost, compact devices, effective use of resources, etc., manufacturers have proposed and commercialized image forming apparatuses employing a cleaner-less image carrier cleaning system, in which a developing unit serves as a cleaning unit by collecting the residual toner not to dispose of but to reuse.

With the cleaner-less image carrier cleaning system that does not include a cleaning unit for collecting and disposing of the residual toner, any toner remaining on the photoconductor after image transfer is conveyed to the charging unit, and consequently the amount of residual toner on the photoconductor can be greater than that in an image forming apparatus equipped with a regular cleaning unit. Therefore, the toner particles can adhere to and accumulate on the charging unit, which can cause the photoconductor to be charged unevenly and produce defective images as a result.

There are various systems for charging the photoconductor. In particular, a roller charge system in which a conductive charge roller contacts the photoconductor for charging the photoconductor is widely known for its minimal environmental impact (ozone non-production), efficient use of space, stable chargeability, etc. However, as the conductive charge roller contacts the photoconductor, the charge roller can easily pick up residual toner remaining on the photoconductor and the toner adhering to the charge roller can be firmly fixed to the surface of the charge roller over time from friction with and/or pressure against the photoconductor. Toner firmly fixed to the photoconductor can be a cause of uneven surface resistance and can therefore cause uneven charging to the photoconductor, which is likely to produce a defective image with streaks or bands.

There is a different system available in which a cleaning member is disposed in contact with a charge roller to remove residual toner from the charge roller. However, when toner accumulates on the charge roller, it is likely to abruptly degrade cleaning ability of the cleaning member and further require removal from the cleaning member. For example, to prevent toner adhesion to a charging member, related-art image forming apparatuses with a cleaner-less system include a charge control unit (e.g., a brush) disposed upstream from the charging member in a direction of movement of the photoconductor so as to control charging of any residual toner.

Specifically, one related-art image forming apparatus with a cleaner-less system includes a charge control unit that can charge residual toner on a photoconductor to a regular polarity and cause the charge amount of residual toner to be sufficient for a developing unit to develop an electrostatic latent image on the photoconductor into a visible toner image. These controls can avoid causing the residual toner remaining on the photoconductor after transfer to easily adhere to the charge roller held in contact with the photoconductor and can cause the developing unit to collect the residual toner on the photoconductor which should not be used for development.

Further, a different configuration for related-art image forming apparatus with a cleaner-less system has been proposed. In this configuration, the related-art image forming apparatus further includes a cleaning film disposed on the charge roller to charge toner between the cleaning film and the charge roller by frictionally charging the toner to the same polarity as the charge roller for easily transferring toner from the charge roller onto the photoconductor. How to avoid toner adhesion to the charge roller and how to remove toner adhering to the charge roller are two issues that heavily affect the prospects for extending the service life of the charge roller.

Additionally, there are other related-art image forming apparatuses with cleaner-less systems having a configuration in which a charge roller does not contact a photoconductor so that toner does not adhere to the charge roller.

One such related-art image forming apparatus employs a charge roller disposed facing a photoconductor across a gap and having difference in levels of electrical resistance between the surface of the charge roller and a sub-surface portion of the charge roller near the surface. With this configuration, the charge roller does discharge to the photoconductor at a portion of maximum resistance but does not discharge to the photoconductor at a portion of minimum resistance. Therefore, the electrical characteristics of the charge roller can remain stable over time, which can reduce unevenness in charging.

Other related-art image forming apparatuses include a charge roller disposed nearly in contact with a photoconductor to form a gap slightly greater than a diameter of a toner particle. This related-art image forming apparatus includes a cleaning roller to collect residual toner by electrostatically attracting the residual toner on the surface of the photoconductor to an upstream direction of rotation of the photoconductor. With this configuration, the related-art image forming apparatus can switch the polarity of electric potential difference between the cleaning roller and the photoconductor during a period other than an image forming period, collect residual toner to adhere to the photoconductor, and convey the collected residual toner carried on the photoconductor to the developing roller for collection.

However, even if the charge roller is disposed across a gap without contacting the photoconductor, toner remaining on the photoconductor may still adhere to the charge roller and gradually accumulate thereon. Consequently, depending on various conditions, the charging roller may eventually fail to provide an even charge after printing approximately 1,000 sheets.

Therefore, the present inventors have conducted extensive research to determine that contamination of the charging member with time can be significantly reduced by disposing a charging member facing but spaced away from a photoconductor and applying thereto a voltage including an alternating current component. Contamination of the charging member is reduced because toner adhering to the charging member is vibrated due to the alternating current voltage and thrown back onto the photoconductor so that the charging member cleans itself.

By contrast, a non-contact charging system to which a voltage having an alternating current component is applied reduces contamination of the charge roller to acceptable levels. However, since less toner adheres to the charging member, a smaller amount of residual toner is spread over the charging member. Therefore, in a region where a toner image transfer rate is poor, residual toner adhering to a previous image or pattern is conveyed to the charge roller. As a result, toner charge distribution after passing the charge roller may shift to a weakly charged side regardless of the toner charge distribution extant when supplying the residual toner to the charge roller due to the alternating current voltage applied to the charge roller. The shift of the toner charge distribution to the weakly charged side can reduce an image force between the toner and the photoconductor, and this can enhance toner collection. However, when a supply amount of residual toner to the charge roller is significantly large, some toner particles may be charged to a regular polarity intensively, which can hinder toner collection. If the regularly charged toner particles are not collected, these toner particles may cause residual images.

Further, the electric potential of the photoconductor can be easily uneven depending on location. To prevent such unevenness in electrical charge potential, to some extent a strong electrical field needs to be applied. However, such strong electrical fields can produce a proportional amount of discharge products, which can cause problems such as image deletion or image blur due to filming caused by toner adhering to the photoconductor. However, by applying a voltage including an alternating current component to the charge roller disposed facing the photoconductor across a gap, the stability of the electric potential of the photoconductor can be enhanced substantially.

On the other hand, as described above, toner that passes through a gap formed between the charge roller and the photoconductor is vibrated due to the alternating current voltage and thrown onto the photoconductor, and therefore small amounts of toner can adhere to the charge roller to gradually accumulate thereon. Since it is difficult to return the toner that adhering to the charge roller not contacting the photoconductor to the photoconductor, the toner adhering to the charge roller must be returned to the photoconductor by some other means.

SUMMARY OF THE INVENTION

Exemplary aspects of the present invention have been made in view of the above-described circumstances.

Exemplary aspects of the present invention provide an image forming apparatus that can stably form images over an extended period of time by preventing defective images produced due to contamination of a charging member and residual images due to residual toner.

In one exemplary embodiment, an image forming apparatus includes an image carrier, a charging unit, a latent image forming unit, a developing unit, a transfer unit, and a toner spreading member. The image carrier carries an image thereon. The charging unit is disposed in the vicinity of the image carrier to charge the image carrier, and includes a charge member being disposed facing the image carrier across a gap therebetween. The charge member charges the image carrier using electrical discharge caused by applying thereto a voltage including an alternating current component superimposed on a direct current component. The latent image forming unit is disposed in the vicinity of the image carrier to form a latent image on the image carrier. The developing unit is disposed in the vicinity of the image carrier to supply toner for developing the latent image formed on the image carrier into a toner image and to collect residual toner remaining on the image carrier. The transfer unit is disposed in the vicinity of the image carrier to transfer a toner image formed on the image carrier onto a recording medium. The toner spreading member spreads toner on the image carrier and is disposed upstream from the charging unit in a direction of movement of the image carrier and downstream from the transfer unit in the direction of movement of the image carrier.

The toner spreading member may spread toner by performing toner collection by collecting at least a part of residual toner and by performing toner discharge by discharging at least a part of collected toner.

The toner collection may be performed in an image forming region and the toner discharge may be performed in a non-image forming region.

The toner collection may be performed in an image forming region of the image carrier and toner discharge may be performed in a non-image forming region of the image carrier.

A potential difference between an electric potential of the direct current component of the voltage applied to the toner spreading member and an electric potential of the image carrier during toner collection may be different from the electric potential between the electric potential of the direct current component of the voltage applied to the toner spreading member and the electric potential of the image carrier during toner discharge.

When the electrical charge distribution of the residual toner is moved to a negative polarity side, the direct current component of the voltage applied to the toner spreading member may be greater during toner collection than during toner discharge. When the electrical charge distribution of the residual toner is moved to a positive polarity side, the direct current component of the voltage applied to the toner spreading member may be smaller during toner collection than during toner discharge A frequency of an alternating current component of a voltage applied to the toner spreading member during toner collection may be different from a frequency of an alternating current component of a voltage applied to the toner spreading member during toner discharge.

A voltage applied to the toner spreading member may include only a direct current component during toner collection and includes a direct current component and an alternating current component superimposed on a direct current component during toner discharge.

A voltage applied to the toner spreading member may include an alternating current component superimposed on a direct current both in toner collection and in toner discharge. A frequency of the alternating current component of the voltage applied to the toner spreading member during toner collection may be greater than a frequency of the alternating current component of the voltage applied to the toner spreading member during toner discharge.

The toner spreading member may contact the image carrier with a first contact pressure during toner collection and with a second contact pressure different from the first contact pressure during toner discharge.

The first contact pressure of the toner spreading member against the image carrier during toner collection may be greater than the second contact pressure of the toner spreading member against the image carrier during toner discharge.

The toner spreading member may be a rotary member, and may rotate at a first speed of rotation during toner collection and at a second speed of rotation different from the first speed of rotation during toner discharge.

A velocity difference between a linear velocity of the toner spreading member and a linear velocity of the image carrier during toner discharge may be greater than a velocity difference between a linear velocity of the toner spreading member and a linear velocity of the image carrier during toner collection.

The toner spreading member may be a brush member.

The toner spreading member may slidably be movable in a longitudinal direction thereof.

The toner spreading member may be a blade member.

The toner spreading member may be a roller member.

The toner spreading member may be a roller member disposed facing the image carrier across a gap.

The developing unit may serve as a cleaning unit by collecting the residual toner remaining on the image carrier. The above-described image forming apparatus may further include a gap adjustment mechanism disposed at at least one end of the charge member to adjust a gap between the charging unit and the image carrier.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
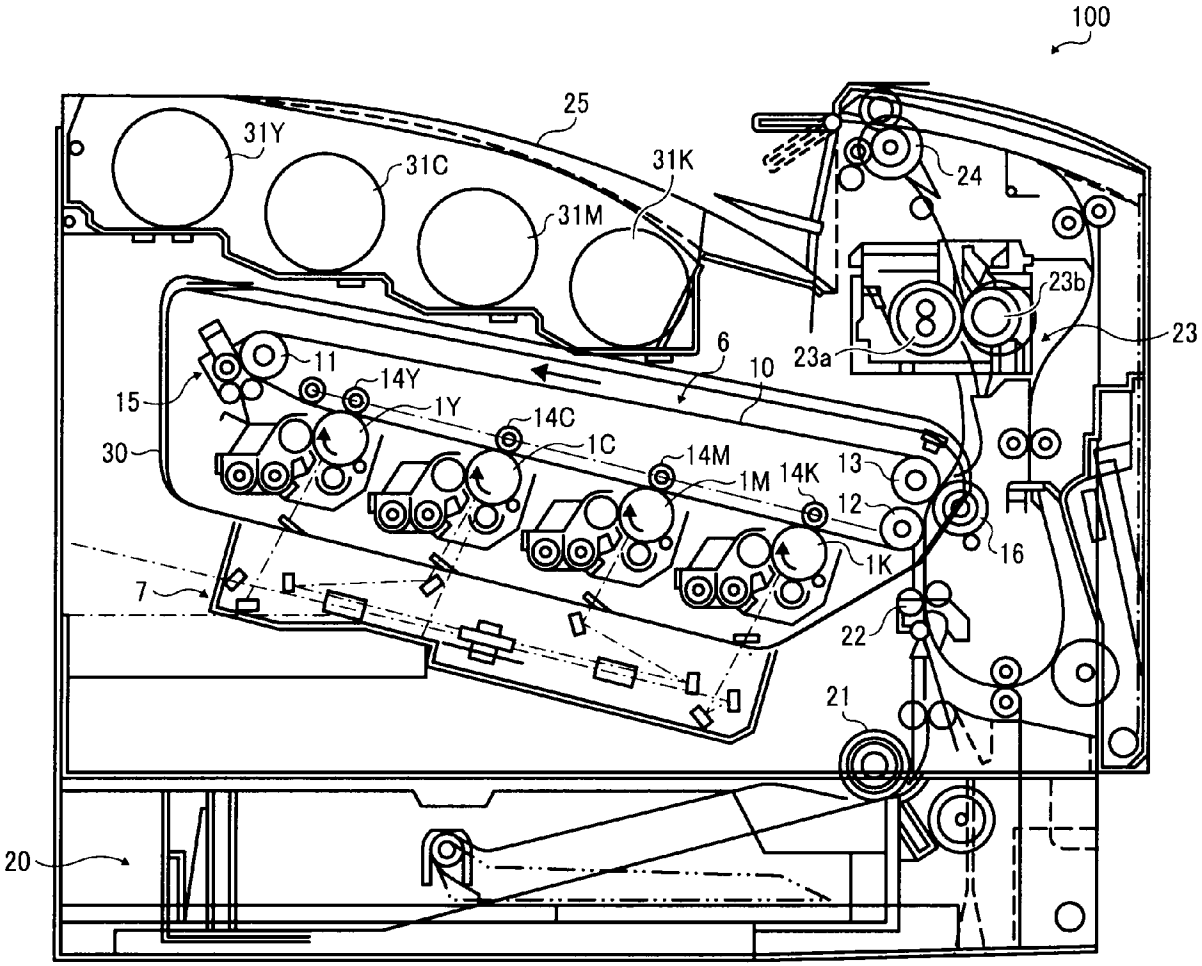
FIG. 1 is a schematic configuration of an electrophotographic image forming apparatus according to an exemplary embodiment of the present invention.

In describing preferred embodiments illustrated in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a schematic configuration of an electrophotographic image forming apparatus 100 according to an exemplary embodiment of the present invention is described.

The image forming apparatus 100 can be any of a copier, a printer, a facsimile machine, a plotter, and a multifunction printer including at least one of copying, printing, scanning, plotter, and facsimile functions. In this non-limiting exemplary embodiment, the image forming apparatus 100 functions as a full-color printing machine or printer for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

The image forming apparatus 100 includes an image forming unit 30, an optical writing unit 7, a sheet feed cassette 20, and a fixing unit 23.

The image forming unit 30 is constituted by four photoconductors 1Y, 1C, 1M, and 1K, a transfer unit 6, and the like.

Each of the photoconductors 1Y, 1C, 1M, and 1K serves as an electrostatic latent image carrier and rotates in a direction indicated by arrow shown in FIG. 1. The photoconductors 1Y, 1C, 1M, and 1K are separately disposed at positions having different heights in a stepped manner. Since the photoconductors 1Y, 1C, 1M, and 1K have similar structures and functions, except that respective images of different single color toners are formed thereon, each of the photoconductors 1Y, 1C, 1M, and 1K will be also referred to as a photoconductor 1. Further, the discussion below occasionally uses reference numerals without suffixes of colors such as Y, C, M, and K for specifying components of the image forming apparatus 100.

Figure 2:
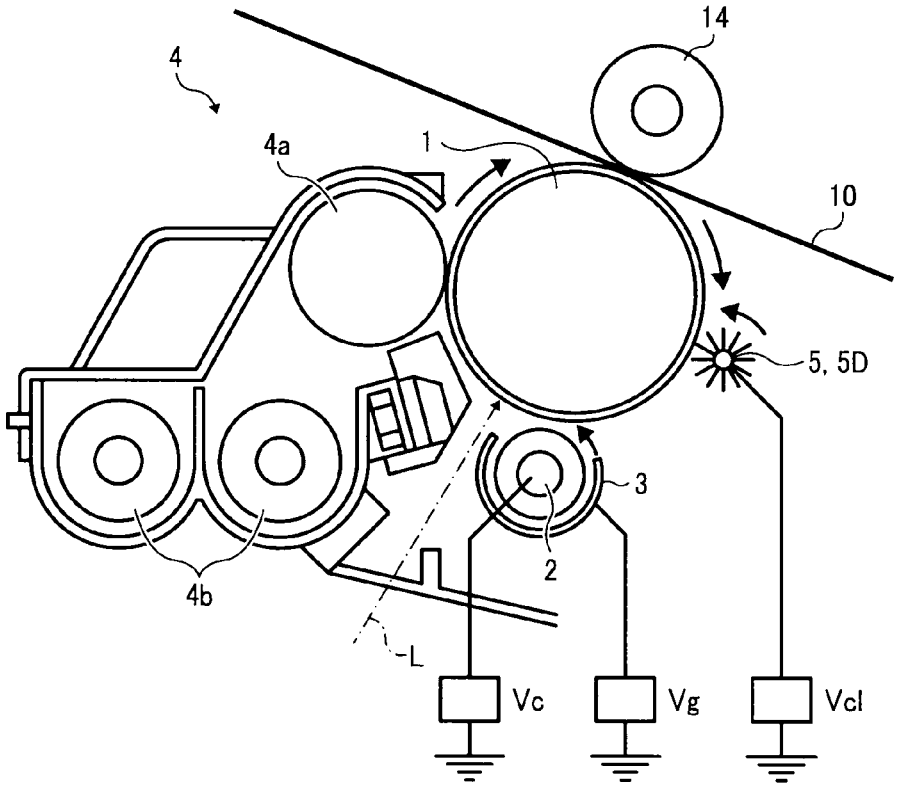
FIG. 2 is a schematic configuration of an image forming unit 30 including a photoconductor and components disposed around the photoconductor, according to an exemplary embodiment of the present invention, including Exemplary Embodiment 4.

The photoconductor 1 has a charge roller 2, a developing unit 4, and a toner spreading member 5 therearound. The charge roller 2, the developing unit 4, and the toner spreading member 5 are shown in FIG. 2, which will be described later.

The photoconductor 1 includes a photoconductive layer covered on a cylindrical aluminum body having a diameter in a range of from approximately 30 mm to approximately 90 mm, for example, and a protection layer on the photoconductive layer. An intermediate layer can be provided between the photoconductive layer and the intermediate layer.

Exemplary embodiments in accordance with the present invention are also not limited to the photoconductor 1 having a drum shape. For example, the present invention can be applied to a photoconductor having a belt shape.

The transfer unit 6 is disposed above each of the photoconductors 1Y, 1C, 1M, and 1K. The transfer unit 6 includes an intermediate transfer belt 10 that is extended by multiple rollers 11, 12, and 13 to rotate. In the transfer unit 6, primary transfer portions are formed between the photoconductors 1Y, 1C, 1M, and 1K and primary transfer rollers 14Y, 14C, 14M, and 14K, respectively, via the intermediate transfer belt 10 to respectively form primary transfer nips. Since the primary transfer rollers 14Y, 14C, 14M, and 14K have similar structures and functions, except that respective images of different single color toners are transferred thereby, each of the primary transfer rollers 14Y, 14C, 14M, and 14K will be also referred to as a primary transfer roller 14.

In the process in which a surface of the intermediate transfer belt 10 passes the intermediate transfer portions for yellow, cyan, magenta, and black as the intermediate transfer belt 10 rotates in an endless manner, a yellow toner image, a cyan toner image, a magenta toner image, and a black toner image formed on the photoconductors 1Y, 1C, 1M, and 1K, respectively, are transferred onto the surface of the intermediate transfer belt 10. This action is referred to as primary transfer. A polarity of transfer current that is applied to the primary transfer rollers 14Y, 14C, 14M, and 14K is a regular polarity that is opposed to a polarity of toner. By so setting, toner particles of each color on the respective single color toner images are attracted toward the primary transfer rollers 14Y, 14C, 14M, and 14K and adhere to the surface of the intermediate transfer belt 10 so as to form a four-color toner image on the surface of the intermediate transfer belt 10.

The transfer unit 6 also includes a secondary transfer portion between the above-described roller 13 supporting and extending the intermediate transfer belt 10 (hereinafter, referred to as a "secondary transfer backup roller 13") and a secondary transfer roller 16 via the intermediate transfer belt 10 to form a secondary transfer nip. In the secondary transfer portion, a transfer sheet that serves as a recording medium is conveyed upward in FIG. 1 while sandwiched between the intermediate transfer belt 10 and the secondary transfer roller 16, both surfaces of which moving in a forward direction.

The four-color toner image formed on the intermediate transfer belt 10 is transferred onto the transfer sheet at the secondary transfer portion to become a full-color toner image. A polarity of transfer current that is applied to the secondary transfer roller 16 is a regular polarity that is opposed to the polarity of toner.

After the surface of the intermediate transfer belt 10 having the toner image has passed the secondary transfer portion, residual toner or foreign materials such as paper powder are removed by a belt cleaning unit 15.

Further, the optical writing unit 7 is disposed below the image forming unit 30. The optical writing unit 7 serves as an exposure unit or a latent image forming unit to emit respective laser light beams L (see FIG. 2) based on image data to irradiate the surfaces of the photoconductors 1Y, 1C, 1M, and 1K. Through this exposure, respective electrostatic latent images for yellow, cyan, magenta, and black images are formed on the surfaces of the photoconductors 1Y, 1C, 1M, and 1K, respectively.

The optical writing unit 7 used for an exemplary embodiment of the present invention receives the laser light beams L emitted by light source, scans the laser light beams L by a polygon mirror rotated by a motor and simultaneously irradiates the photoconductors 1Y, 1C, 1M, and 1K via multiple optical lenses and mirrors.

The sheet feed cassette 20 is disposed at a lower part of or below the main body of the image forming apparatus 100. The sheet feed cassette 20 accommodates stack of transfer sheets therein and includes a sheet feed roller 21 to feed a transfer sheet placed atop the stack and convey the transfer sheet to a pair of registration rollers 22. The pair or registration rollers 22 stops and feeds the transfer sheet in synchronization with a movement of the intermediate transfer belt 10. The transfer sheet is conveyed to the secondary transfer portion where a full-color toner image is transferred thereon.

The fixing unit 23 is disposed at an upper right portion from the image forming unit 30 in FIG. 1. The fixing unit 23 includes a fixing roller 23*a* and a pressure roller 23*b* and forms a fixing nip therebetween.

After receiving the full-color toner image at the secondary transfer portion, the transfer sheet with the full-color toner image thereon is conveyed to the fixing unit 23 so as to fix the toner image thereto by application of heat and pressure at the fixing nip.

The transfer sheet with the fixed toner image is conveyed to a pair of discharging rollers 24 and is discharged to a stacker 25 sequentially.

The fixing unit 23 can be controlled by a controller, not shown, to set an optimal fixing condition according to various operations, for example, a full color image or a monochrome or black-and-white color image, a single-side printing mode or a duplex printing mode, and types of transfer sheets.

Although the fixing unit 23 illustrated herein is generally illustrated to have a configuration having a heater inside a roller, exemplary embodiments of the present invention are not intended to be limited to this configuration. For example, the fixing unit 23 of the present invention may have a configuration employing a belt fixing method or a configuration employing an induction heating method.

Toner cartridges 31Y, 31C, 31M, and 31K are disposed between the image forming unit 30 and the stacker 25 of the image forming apparatus 100.

The toner cartridges 31Y, 31C, 31M, and 31K serve as developer containers to accommodate yellow toner, cyan toner, magenta toner, and black toner, respectively. The yellow toner, cyan toner, magenta toner, and black toner contained in the toner cartridges 31Y, 31C, 31M, and 31K, respectively, are supplied selectively to each developing unit 4 (see FIG. 2) of the image forming unit 30. Each of the yellow toner, cyan toner, magenta toner, and black toner is conveyed by a toner conveyance unit such as a mono pump and an air pump, not shown. The toner cartridges 31Y, 31C, 31M, and 31K and the image forming unit 30 are separately detachably attachable with respect to the image forming apparatus 100.

Referring to FIG. 2, a description is given of a configuration of the image forming unit 30, focusing on the photoconductor 1 and components disposed around the photoconductor 1, according to an exemplary embodiment of the present invention.

As previously described, the photoconductors 1Y, 1C, 1M, and 1K and the components therearound have similar structures and functions, except that respective images of different single color toners are formed on the respective photoconductors 1Y, 1C, 1M, and 1K. Therefore, the photoconductors 1Y, 1C, 1M, and 1K will be referred to as a photoconductor 1 and the discussion below will use reference numerals without suffixes of colors such as Y, C, M, and K for specifying components of the image forming apparatus 100.

As shown in FIG. 2 and previously described, the charge roller 2, the developing unit 4, and the toner spreading member 5 are disposed in this order along a direction of movement of the surface of the photoconductor 1. Further, a guard member 3 is disposed partially surrounding the charge roller 2. The guard member 3 will be described later.

The charge roller 2 serves as a charging member of a charging unit and is disposed facing the photoconductor 1 without contacting the photoconductor 1 to have a gap therebetween. Under this condition, the charge roller 2 uniformly charges the surface of the photoconductor 1.

The developing unit 4 includes a developing roller 4*a* and a pair of agitators 4*b* and accommodates two-component developer including toner particles and carrier particles.

The toner spreading member 5 is applied by an application bias voltage Vcl.

In a configuration employing a cleaner-less system, the photoconductor 1 is charged by the charge roller 2 and exposed with the laser light beam L by the optical writing unit 7, with residual toner remaining on the photoconductor 1 after passing the primary transfer portions, so as to form an electrostatic latent image on the surface of the photoconductor 1. Then, the developing unit 4 supplies new toner over the residual toner on newly exposed or irradiated portions of the electrostatic latent image on the photoconductor 1. At this time, the residual toner on unexposed portions is transferred to the developing unit 4 to be collected. That is, the residual toner on unexposed portions may be cleaned and recycled.

As described above, the developing unit 4 performs a cleaning operation and a developing operation at the same time. A following description is given of the principle of this action of the developing unit 4.

In reversal development, the developing unit 4 to which a voltage lower than the charge potential of an unexposed portion of the photoconductor 1 is applied supplies toner that is charged with a negative polarity or a polarity same as the charge polarity of the photoconductor 1 with respect to an exposed portion where its surface potential has dropped close to zero. At this time, residual toner on the unexposed portion of the photoconductor 1 is collected by moving from the photoconductor 1 to the developing unit 4 due to an electrical potential difference between the photoconductor 1 and the charge roller 2. Thus, by collecting the residual toner by the developing unit 4 to reuse for development, a wasted toner tank for containing toner that has been collected by cleaning the photoconductor 1 may not be necessary, which can achieve a smaller image forming apparatus, for example. Especially, a tandem-type color image forming apparatus in which four photoconductors are disposed in parallel can be reduced significantly in size when respective wasted toner conveyance routes that are provided separately to corresponding photoconductors are eliminated. Further, toner recycling can contribute to low cost, and therefore lead to a reduction in running cost and an increase in maintenance performance.

It is preferable that the developing unit 4 uses two-component developer including toner particles and carrier particles. Carrier that is positively charged attracts residual toner that is negatively charged or is charged to a regular polarity so as to collect the toner to the developing unit 4. Further, friction between a magnetic brush and the photoconductor 1 in a development region can cause toner on the photoconductor 1 to be easily collected mechanically. By contrast, a developing unit employing one-component toner can alternatively be used. In this case, the developing unit can be reduced in size and cost. The residual toner regularly charged by contact pressure of the photoconductor 1 and the developing roller 4*a* and electrical field can be collected to the developing unit.

Figure 3:
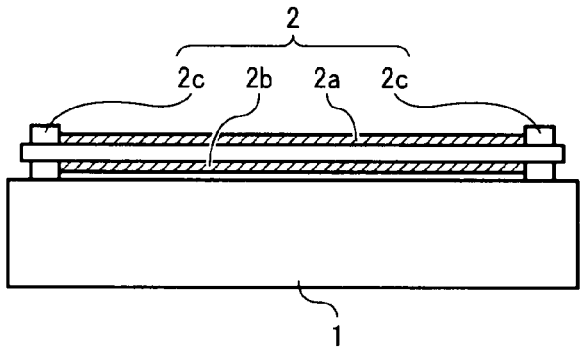
FIG. 3 is a schematic structure of a charge roller disposed facing the photoconductor of FIG. 2.

Next, referring to FIG. 3, a schematic structure of the charge roller 2 is described. FIG. 3 is a cross-sectional view of the photoconductor 1 and the charge roller 2 along an axial direction thereof.

As shown in FIG. 3, the charge roller 2 includes a shaft 2*a*, a main body 2*b*, and spacers 2*c*.

The main body 2*b* of the charge roller 2 is disposed to cover the shaft 2*a*.

The spacers 2*c* are located at both ends of the shaft 2*a* along its longitudinal direction. The spacers 2*c* of the charge roller 2 are disposed such that the photoconductor 1 and the main body 2*b* of the charge roller 2 can be disposed facing each other across a given gap of from approximately 20 μm to approximately 80 μm and cause an adjacent discharge with respect to the photoconductor 1 to charge the surface of the photoconductor 1 to a constant potential. In an exemplary embodiment, the charge roller 2 has an outer diameter of 12 mm and closely contacts with the photoconductor 1 across a gap of 50 μm. To obtain −600V of a surface electric potential of the photoconductor 1, the charge roller 2 is applied by a negative charge bias voltage Vc (see FIG. 2) superimposed by the alternating voltage and a current voltage.

Further, as shown in FIG. 2, the guard member 3 is disposed partially surrounding the charge roller 2, with 1 mm to 5 mm apart from the charge roller 2. The guard member 3 is formed of metal such as aluminum and iron or resin including conductive material. The guard member 3 is connected to the power source to apply a bias voltage Vg (see FIG. 2). The charge roller 2 is applied to the charge bias voltage Vc superimposed by an alternating voltage. Therefore, the toner adhering to the charge roller 2 may be attracted by the alternating voltage and returned to the photoconductor 1 and the contamination of the surface of the charge roller 2 may not become a problem. While preventing members or components disposed around the charge roller 2 from being contaminated by the toner vibrated by the alternating voltage to be transferred thereto, the guard member 3 may play a role to return the toner accumulated on the guard member 3 to the charge roller 2.

Figure 4:
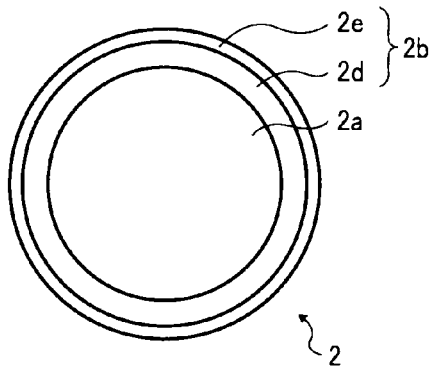
FIG. 4 is a cross-sectional view of the charge roller of FIG. 3 in a diameter direction.

Referring to FIG. 4, a schematic structure of the charge roller 2 is described. FIG. 4 is a cross-sectional view of the charge roller 2 in a diameter direction.

As shown in FIG. 4, the main body 2*b* of the charge roller 2 includes a resistance adjustment layer 2*d* disposed around the shaft 2*a*, and a protection layer 2*e* disposed on top of the charge roller 2 and covers around the resistance adjustment layer 2*d*.

The shaft 2*a* of the charge roller 2 includes, for example, a high-conductive metallic material having a diameter of 8 mm to 20 mm and high rigidity such as stainless steel and aluminum or a high-conductive resin material having high rigidity and a volume resistivity smaller than $1\times10^3$ Ω·cm, preferably a volume resistivity smaller than $1\times10^2$ Ω·cm.

It is preferable that the resistance adjustment layer 2*d* of the charge roller 2 has a volume resistivity of from $1\times10^5$ Ω·cm to $1\times10^9$ Ω·cm and a thickness of from 1 mm to 2 mm. It is preferable that the protection layer 2*e* of the charge roller 2 has a volume resistivity of from $1\times10^6$ Ω·cm to $1\times10^{10}$ Ω·cm and a thickness of approximately 10 μm. The volume resistivity of the protection layer 2*e* of the charge roller 2 is preferably higher than the electrical resistivity of the resistance adjustment layer 2*d*.

While a conventionally resistance adjustment layer includes rubber such as hydrin rubber, the resistance adjustment layer 2*d* of the present invention includes thermoplastic resin composition containing ionic conductive polymer material. The thermoplastic resin composition has a lower coefficient of expansion than a rubber material and maintains the dimensional accuracy both in initial time and over time. For a base resin composing such thermoplastic resin composition, polyethylene, polypropylene, polystyrene, polymethylmetacrylate (PMMA), acrylonitrile-styrene copolymer, and acrylonitrile-butadiene copolymer can be used. Ionic conductive polymer material that is contained in the thermoplastic resin composition preferably includes polymer compound containing polyether ester amid component.

The protection layer 2*e* of the charge roller 2 includes a resin selected among the protection layer 2*e* of the charge roller 2, acrylic-silicone resin, fluorocarbon resin, silicone resin, acrylic resin, polyamide resin, polyurethane resin, polyester resin, and polyvinyl butyral resin. Since these resins are good in non-cohesion, the charge roller 2 can effectively perform against toner adhesion. Further, since these resins are electrically insulated, the protection layer 2*e* formed by a single resin cannot obtain the characteristics as the charge roller 2. Therefore, the protection layer 2*e* of the charge roller 2 in an exemplary embodiment of the present invention includes conductive particles for resin composition. Preferable examples for the resin composition are metallic oxide such as tin oxide and ferric oxide, and carbon black such as acetylene black and ketjen black.

The spacers 2*c* of the charge roller 2 include polyethylene resin and the like. In particular, even when a polyethylene resin having one million or more molecular weight is used for a long period of time, a stable space between the photoconductor 1 and the main body 2*b* of the charge roller 2 can be maintained. The reason why resins can be used for the charge roller 2 is that the charge roller 2 is disposed facing the photoconductor 1 across a gap. If a contact-type charge roller includes a resin material, no elasticity is provided to stable the charge nip, and therefore such charge roller cannot charge the photoconductor 1 evenly. In the cleaner-less system in which a large amount of toner is input to the charge roller 2, by disposing the charge roller 2 without contacting the photoconductor 1, the charging roller 2 can include a resin having good durability and good performance against toner adhesion.

Figure 5A:
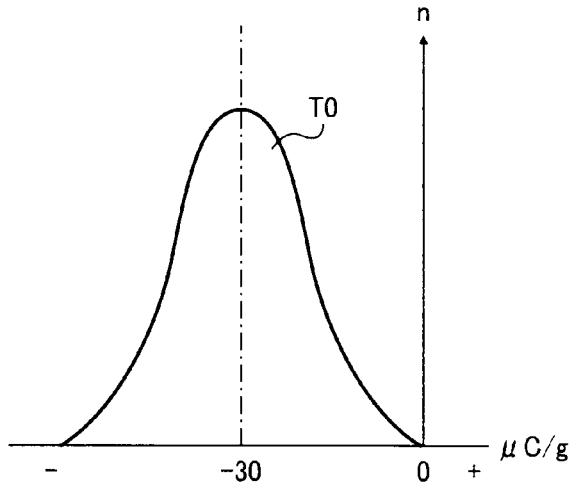
FIG. 5A is a graph of toner charge potential distribution immediately before transfer of toner carried on the photoconductor of FIG. 2.
Figure 5B:
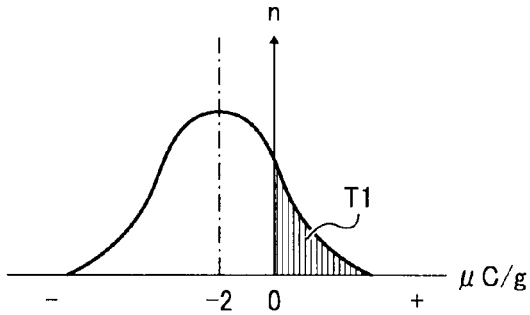
FIG. 5B is a graph of toner charge potential distribution of residual toner remaining on the photoconductor after transfer of the toner carried on the photoconductor of FIG. 2.

Next, referring to FIGS. 5A and 5B, a description is given of residual toner remaining on the surface of the photoconductor 1 even after a toner image formed on the surface of the photoconductor 1 has been transferred onto the intermediate transfer belt 10.

The residual toner contains mixture of toner charged to a given regular polarity, hereinafter a "regularly charged toner T0", and toner charged to a polarity that is opposite to the regular polarity, hereinafter a "reversely charged toner T1".

FIG. 5A is a graph of a toner charge potential distribution immediately before the toner carried on the photoconductor 1 is transferred. FIG. 5B is a graph of a toner charge potential distribution of residual toner remaining on the surface of the photoconductor 1 after the toner carried on the photoconductor 1 is transferred.

As shown in FIG. 5A, the charge amounts of toner immediately before transfer are distributed centering on approximately −30 μC/g, and most of them are the regularly charged toner T0 charged to a negative polarity. By contrast, as shown in FIG. 5B, the charge amounts of charge of residual toner remaining on the photoconductor 1 are distributed centering on approximately −2 μC/g. Generally, a part of the residual toner reserves to the regular polarity because of, for example, electrical discharge caused in the vicinity of a transfer region by a difference between an electric potential of a positive bias applied to the primary transfer roller 14 and an electric potential of the photoconductor 1. As a result, the residual toner may include the reversely charged toner T1, as shown in a diagonally shaded area of FIG. 5B, with its polarity being reversed to the positive polarity.

When conveyed to the charge area of the charge roller 2 while remaining on the photoconductor 1, the above-described reversely charged toner T1 is electrostatically attracted to the surface of the charge roller 2 that is charged by a bias voltage with a negative polarity and adheres to the surface of the charge roller 2 as a result. However, the reversely charged toner T1 receives vibration caused by the alternating current voltage applied to the charge roller 2 and returns to the photoconductor 1 from the charge roller 2. Since the charge roller 2 is disposed facing the photoconductor 1 in a non-contact manner, the toner adhering to the surface of the charge roller 2 can return to the photoconductor 1 without being pressed and crushed. Therefore, contamination of the surface of the charge roller 2 may not become a problem regardless of the charge potential distribution of residual toner.

The charge potential distribution of toner that has passed the charge roller 2 may be affected by the alternating current voltage of the charge roller 2 and may shift to a weakly charged side regardless of the charge potential distribution at an input to the charge roller 2. As the toner charge weakens, an image force between the photoconductor 1 and the toner particles may also become weaker. Therefore, toner recoverability for development may increase. However, if an amount of input of residual toner to the charge roller 2 is substantially large, a part of toner can be strongly charged to the regular polarity, and recovery of such toner may be hindered. Such regularly charged toner that has failed to recover can be a cause of residual image. To reduce the possibility of occurrence of residual image, the toner spreading member 5 is necessarily or essentially provided.

The following exemplary embodiments of the present invention describe details of various configurations of the toner spreading member 5.

Exemplary Embodiment 1

Figure 6:
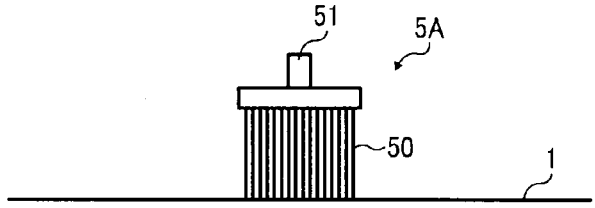
FIG. 6 is a schematic configuration of a toner spreading brush according to Exemplary Embodiment 1 of the present invention.

Referring to FIG. 6, a schematic configuration of a toner spreading brush 5A is described.

The toner spreading brush 5A corresponds to the toner spreading member 5 with a configuration shown in FIG. 6.

As shown in FIG. 6, the toner spreading brush 5A is formed by a conductive brush including fibers of acrylic or nylon resin composing a conductive material such as carbon black, or of PET, etc. The toner spreading brush 5A includes a brush portion 50 and a supporting portion 51.

The brush portion 50 of the toner spreading brush 5A has a length shorter than the length of the photoconductor 1 in an axial direction and greater than the length of the developing roller 4*a* in an axial direction.

The supporting portion 51 supports the brush portion 50 to slide reciprocally in a longitudinal direction thereof to spread residual toner remaining on the photoconductor 1 in that direction. By spreading residual toner as described above, the residual toner may not remain on local areas of the photoconductor 1. However, the above-described movement or sliding motion of the toner spreading brush 5A with the potential being grounded may move the residual toner only in a short range or distance that corresponds to a width of sliding motion of the toner spreading brush 5A. This can make the boundary blurry but a residual toner may remain when an output image includes a chart of thick bands. By collecting and gathering the residual toner to the toner spreading brush 5A and discharging the collected residual toner at a predetermined or given time or in a predetermined or given region, the residual toner can be moved for a longer distance.

For example, the toner spreading brush 5A can collect at least a part of residual toner in an image forming region and discharge the at least a part of collected residual toner to a non-image forming region. The "image forming region" indicates a region on the photoconductor 1 where an image that is transferred onto a recording medium or a transfer sheet can be formed. The "non-image forming region" indicates a region on the photoconductor 1 other than the image forming region, and includes regions corresponding to an area between transfer sheets, a margin on the trailing edge of a first transfer sheet, and a margin on the leading edge of a second transfer sheet following the first transfer sheet. Alternatively, the toner spreading brush 5A can collect at least a part of residual toner in an image area and discharge the at least part of collected residual toner to a non-image area. The "image area" indicates a region on the photoconductor 1 where an image that is transferred onto a recording medium or a transfer sheet is formed exists in an axial direction of the photoconductor 1. The "non-image area" indicates a region on the photoconductor 1 where an image that is transferred onto a recording medium or a transfer sheet is formed does not exist in an axial direction of the photoconductor 1. The non-image area can correspond to the non-image forming region and any area on the image forming region without an image.

Before the residual toner remaining on the photoconductor 1 passes the charge roller 2, the residual toner existing on a portion where a large amount of residual toner remains may be moved to a portion where a small amount of residual toner remains. By so doing, occurrence of a residual image can be reduced. It is most desirable to discharge the residual toner to the non-image forming region. If the residual toner is discharged to the non-image forming region, even when a residual image appears on the photoconductor 1, the residual image may not adversely affect on an output image.

The toner spreading brush 5A can provide parameters, for example, application bias voltage and contact pressure, and easily control the collection and discharge of residual toner. Hereinafter, the collection of residual toner is referred to as "toner collection" and the discharge of residual toner is referred to as "toner discharge". The toner spreading brush 5A can control the toner collection and toner discharge by controlling an application bias voltage that is applied to the toner spreading brush 5A and by changing a potential difference between an electric potential of the direct current component of the application bias voltage applied to the toner spreading brush 5A and an electric potential of the photoconductor 1 during the toner collection and the toner discharge.

When the toner charge distribution of the residual toner is moved to a negative polarity side, it is preferable that the application bias voltage applied to the toner spreading brush 5A satisfies a relation of "(DC component of the application bias voltage during toner collection in the image forming region)>(DC component of the application bias voltage during toner discharge in the non-image forming region)" or a relation of "(DC component of the application bias voltage during toner collection in the image area)>(DC component of the application bias voltage during toner discharge in the non-image area)".

By contrast, when the toner charge distribution of the residual toner is moved to a positive polarity side, it is preferable that the application bias voltage applied to the toner spreading brush 5A satisfies a relation of "(DC component of the application bias voltage during toner collection in the image forming region)<(DC component of the application bias voltage during toner discharge in the non-image forming region)" or a relation of "(DC component of the application bias voltage during toner collection in the image area)<(DC component of the application bias voltage during toner discharge in the non-image area)".

By setting the above-described potential difference of the electric potentials, the residual toner can be collected in the image forming region or in the image area and can be discharged in the non-image forming region or in the non-image area, thereby effectively distributing the residual toner.

Further, the toner spreading brush 5A can effectively control the toner collection and the toner discharge by changing a frequency of alternating current component of an application bias voltage that is applied to the toner spreading brush 5A. The toner spreading brush 5A can discharge residual toner more easily when the application bias voltage has a low frequency AC component superimposed on a DC component than when the application bias voltage has a DC component only. For example, the application bias voltage that is applied to the toner spreading brush 5A does not include an AC component during the toner collection in the image forming region or in the image area and includes an AC component during the toner discharge in the non-image forming region or in the non-image area. Alternatively, the application bias voltage that is applied to the toner spreading brush 5A may include an AC component superimposed on a DC component during the toner collection in the image forming region or the image area and during the toner discharge in the non-image forming region or the non-image area. In this case, it is preferable that the application bias voltage applied to the toner spreading brush 5A satisfies a relation of "(Frequency of the application bias voltage during toner collection in the image forming region)>(Frequency of the application bias voltage during toner discharge in the non-image forming region)" or a relation of "(Frequency of the application bias voltage during toner collection in the image area)<(Frequency of the application bias voltage during toner discharge in the non-image area)". That is, the residual toner can be discharged from the toner spreading brush 5A more easily when the application bias voltage having a low frequency AC component is applied than when the application bias voltage having a high frequency AC component is applied.

Exemplary Embodiment 2

Figure 7A:
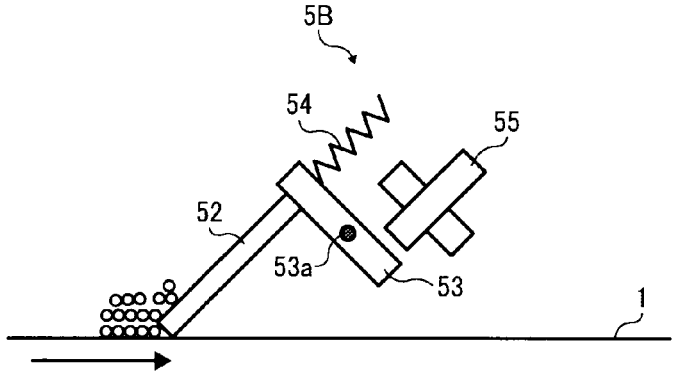
FIG. 7A is a drawing for explaining a positional relation of a toner spreading blade and the photoconductor in an image forming region according to Exemplary Embodiment 2 of the present invention.
Figure 7B:
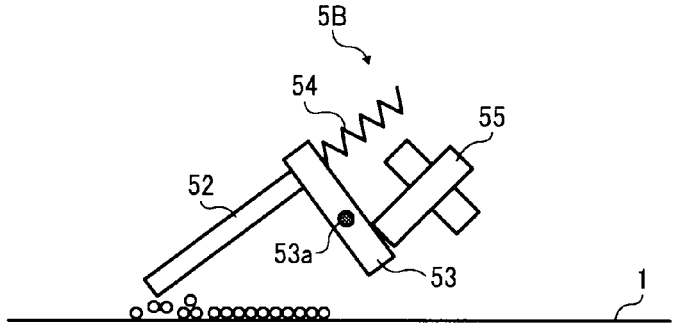
FIG. 7B is a drawing for explaining a positional relation of the toner spreading blade and the photoconductor in a non-image forming region.
Figure 8:
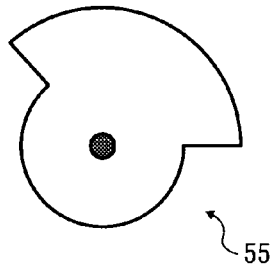
FIG. 8 is a cross-sectional view showing a structure of an eccentric cam used for the toner spreading brush of FIGS. 7A and 7B.

Referring to FIGS. 7A, 7B, and 8, a schematic configuration of a toner spreading blade 5B is described.

The toner spreading blade 5B corresponds to the toner spreading member 5 with a configuration shown in FIGS. 7A and 7B.

FIG. 7A is a drawing for explaining a positional relation of the toner spreading blade 5B and the photoconductor 1 during toner collection in the image forming region. FIG. 7B is a drawing for explaining the positional relation of the toner spreading blade 5B and the photoconductor 1 during toner discharge in the non-image forming region. FIG. 8 is a cross-sectional view showing a structure of an eccentric cam.

As shown in FIGS. 7A, 7B, and 8, the toner spreading blade 5B includes a blade part 52, an arm 53, a spring 54, and an eccentric cam 55.

The blade part 52 is formed by elastic material such as urethane rubber.

The arm 53 includes a fulcrum 53*a* at its center and supports the blade part 52 at one end thereof.

The spring 54 biases the arm 53 in a direction toward the photoconductor 1.

The eccentric cam 55 has a cross-sectional view as shown in FIG. 8 and contacts the other end of the arm 53 at a predetermined or given time and biases in a direction opposite the direction to which the spring 54 biases the arm 53.

The toner spreading blade 5B can vary an angle of the blade part 52 with a biasing force of the spring 54 and a rotation of the eccentric cam 55 so as to change the contact pressure of the blade part 52 to the photoconductor 1.

As shown in FIG. 7A, the spring 54 applies the biasing force to the blade part 52 to increase the contact pressure between the blade part 52 and the photoconductor 1 during the toner collection in the image forming region or the image area, so that the blade part 52 can collect the residual toner remaining on the surface of the photoconductor 1.

By contrast, as shown in FIG. 7B, when the eccentric cam 55 rotates by a given angle, the blade part 52 may be moved by the eccentric cam 55 to separate from the surface of the photoconductor 1 to form a gap during the toner discharge in the non-image forming region or the non-image area, so that the collected residual toner can be discharged from the blade part 52 to the region or area.

Even when a large amount of collected residual toner is leaked from the gap between the photoconductor 1 and the blade part 52, the charge roller 2 can perform so-called self-cleaning, that is, can clean itself effectively. Therefore, any contamination of the charge roller 2 may not be an issue that heavily affect the prospects for extending the service life. Further, relative inexpensiveness of the blade part 52 can lead to low cost in manufacturing of the toner spreading member 5.

Exemplary embodiments in accordance with the present invention are also not limited to the clutch mechanism shown in FIGS. 7A and 7B for adjustment of the gap between the photoconductor 1 and the blade part 52 and can employ a different mechanism. Further, when performing the toner collection in the image forming region or the image area and toner discharge in the non-image forming region or the non-image area, the toner spreading blade 5B can control the toner collection and the toner discharge by changing the potential difference between the electric potential of the DC component of the application bias voltage applied to the toner spreading blade 5B and the electric potential of the DC component of the application bias voltage applied to the photoconductor 1 or by changing the frequency of the AC component of the application bias voltage applied to the toner spreading blade 5B during the toner collection and the frequency of the AC component of the application bias voltage applied to the toner spreading blade 5B during the toner discharge, which is same as Exemplary Embodiment 1.

Exemplary Embodiment 3

Figure 9:
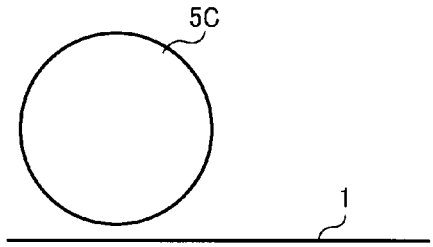
FIG. 9 is a drawing for explaining a positional relation of a toner spreading roller and the photoconductor according to Exemplary Embodiment 3 of the present invention.

Referring to FIG. 9, a schematic configuration of a toner spreading roller 5C is described.

The toner spreading roller 5C corresponds to the toner spreading member 5 with a configuration shown in FIG. 9, which is a same shape as the charge roller 2.

FIG. 9 is a drawing for explaining a positional relation of the toner spreading roller 5C and the photoconductor 1.

The toner spreading roller 5C includes material having a small adhesion force to toner, which is the same characteristic as the charge roller 2, and maintains a highly accurate gap with the photoconductor 1. Therefore, toner may not firmly fix or adhere to the toner spreading roller 5C. Further, the toner spreading roller 5C may not easily change the amount of residual toner in the toner collection and the amount of residual toner in the toner discharge with time. Same as Exemplary Embodiment 1, the toner collection in the image forming region or the image area and the toner discharge in the non-image forming region or the non-image area can be controlled by changing the potential difference between the electric potential of the DC component of the application bias voltage applied to the toner spreading roller 5C and the electric potential of the DC component of the application bias voltage applied to the photoconductor 1 or by changing the frequency of the AC component of the application bias voltage applied to the toner spreading roller 5C during the toner collection and the frequency of the AC component of the application bias voltage applied to the toner spreading roller 5C during the toner discharge.

Detailed descriptions are given of examples and the results of the toner collection and the toner discharge with the toner spreading roller 5C according to Exemplary Embodiment 3.

Example 1

When a Large Amount of Residual Toner is Charged to a Negative Polarity in a Charge Distribution of Residual Toner Since it is desired to collect a larger amount of negatively charged residual toner in the image forming region, the application bias voltage having a positive polarity (e.g., +300V) was applied to the toner spreading roller 5C. Further, since it is desired to discharge the collected residual toner in the non-image forming region, the application bias voltage having a negative polarity (e.g., −300V) was applied to the toner spreading roller 5C. When only the DC component was applied, not all residual toner could be discharged. Therefore, the inventors of the present invention applied the AC component (e.g., 100 Hz, 600 Vpp) superimposed on the DC component (−300V). With this application, the residual toner from the toner spreading roller 5C could be effectively discharged.

Example 2

When a Large Amount of Residual Toner Appears Symmetrical with Respect to the Y-Axis in FIG. 7*b* or is Charged to a Positive Polarity in a Charge Distribution of Residual Toner To the contrary to Example 1, the application bias voltage having a negative polarity (e.g., −300V) was applied to the toner spreading roller 5C for the toner collection in the image forming region and the application bias voltage in which the AC component (e.g., 100 Hz, 600 Vpp) was superimposed on the DC component having a positive polarity (e.g., +300V) was applied to the toner spreading roller 5C for the toner discharge in the non-image forming region. By so doing, the toner collection in the image forming region and the toner discharge in the non-image forming region could be performed successfully.

Example 3

When Residual Toner is Strongly Charged

Since the residual toner cannot be collected without weakening the charge thereof, the application bias voltage having the AC component superimposed on the DC component was applied to the toner spreading roller 5C for the toner collection in the image forming region. By applying the application bias voltage with the AC component superimposed on the DC component, the charge of the residual toner was weakened and the toner spreading roller 5C could therefore collect the residual toner successfully. However, it is difficult to collect the residual toner without increasing a frequency of an AC component for the toner collection in the image forming region. For example, when the frequency of the AC component of 2,000 hertz [Hz] was superimposed on the DC component, the residual toner was weakened and collected at the same time. By contrast, in the non-image forming region, the frequency of the AC component of approximately 100 hertz [Hz] was superimposed on the DC component according to Examples 1 and 2 so that the residual toner could be discharged from the toner spreading roller 5C successfully. Thus, the application bias voltage including the AC component superimposed on the DC component with a low frequency can cause the residual toner to be discharge more easily than applying the application bias voltage including the AC component superimposed on the DC component with a high frequency.

Exemplary Embodiment 4

As shown in FIG. 2, the toner spreading brush roller 5D according to Exemplary Embodiment 4 of the present invention corresponds to the toner spreading member 5 and is formed by a conductive brush including fibers of acrylic or nylon resin composing a conductive material such as carbon black, or of PET, etc. The toner spreading brush roller 5D can allocate all parameters of a speed of rotation (i.e., a linear velocity difference with respect to a photoconductor), the application bias voltage Vcl (see FIG. 2), and a contact pressure. Therefore, the toner collection in the image forming region or the image area and the toner discharge in the non-image forming region or the non-image area can be controlled easily.

For example, the toner collection and the toner discharge can be controlled by setting the speed of rotation of the toner spreading brush roller 5D to satisfy a relation of (Velocity difference between the linear velocity of the photoconductor 1 and the linear velocity of the toner spreading brush roller 5D during the toner collection in the image forming region)< (Velocity difference between the linear velocity of the photoconductor 1 and the linear velocity of the toner spreading brush roller 5D during the toner discharge in the non-image forming region).

In this exemplary embodiment, the velocity difference between the linear velocity of the photoconductor 1 and the linear velocity of the toner spreading brush roller 5D during the toner collection in the image forming region is set to 0 mm/s. This setting can increase the performance ability of toner collection by the toner spreading brush roller 5D significantly. Further, the velocity difference between the linear velocity of the photoconductor 1 and the linear velocity of the toner spreading brush roller 5D during the toner discharge in the non-image forming region is set to 500 mm/s. This setting can promote the easy discharge of residual toner from the toner spreading brush roller 5D.

The above-described velocity difference of the linear velocity of the photoconductor 1 and the linear velocity of the toner spreading brush roller 5D can be adjusted by changing the speed of rotation of a motor that drives the toner spreading brush roller 5D. The adjustment can also be performed by using a clutch mechanism. With the clutch mechanism, the motor and the toner spreading brush roller 5D can be disconnected in the image forming region to rotate the toner spreading brush roller 5D with the photoconductor 1, which can cause the velocity difference of the linear velocity of the photoconductor 1 and the linear velocity of the toner spreading brush roller 5D to become close to 0 mm/s. The application bias voltage applied to the toner spreading brush roller 5D can be controlled in the same way as described in Exemplary Embodiment 3.

Exemplary Embodiment 5

Figure 10A:
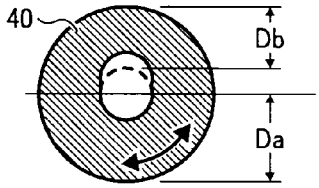
FIG. 10A is a drawing showing an example of a shaft positioning member of a gap adjustment mechanism according to Exemplary Embodiment 5 of the present invention.
Figure 10B:
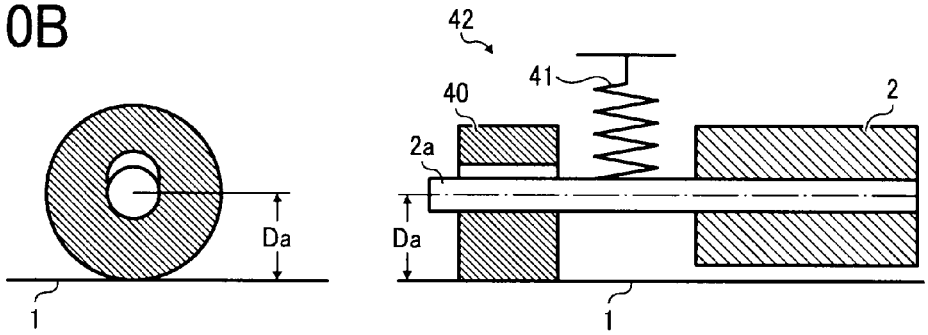
FIG. 10B is a drawing for explaining the gap adjustment mechanism including the shaft positioning member of FIG. 10A when positioning the charge roller with a distance Da.
Figure 10C:
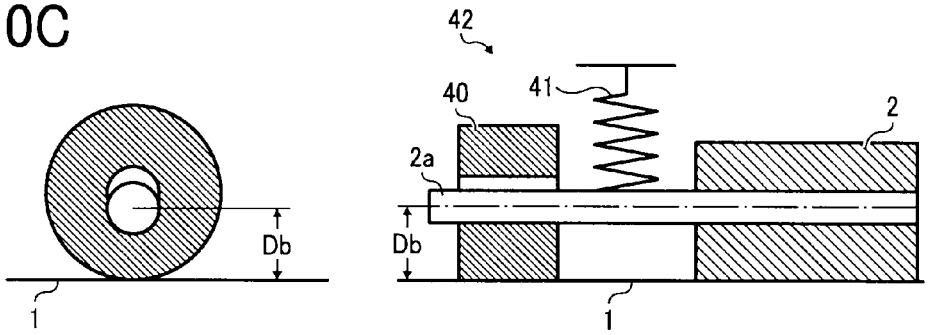
FIG. 10C is a drawing for explaining the gap adjustment mechanism including the shaft positioning member of FIG. 10A when positioning the charge roller with a distance Db.

Next, a description is given of a gap adjustment mechanism 42 for changing the gap formed between the charge roller 2 and the photoconductor 1 in the image forming apparatus 100 according to Exemplary Embodiment 5 of the present invention, in reference to FIGS. 10A, 10B, and 10C.

The gap adjustment mechanism 42 includes a shaft positioning member 40 and a pressing member 41, as shown in FIGS. 10A through 10C. The gap adjustment mechanism 42 is disposed at least one end of the shaft 2*a* of the charge roller 2 and is held in contact with the surface of the photoconductor 1.

The shaft positioning member 40 is round-shaped and contacts a longitudinal end portion of the photoconductor 1. The shaft positioning member 40 has an elongate hole at a substantially center of its cross-section so as to change a position of the shaft 2*a* of the charge roller 2, as shown in FIG. 10A.

The pressing member 41 constantly presses the shaft 2*a* of the charge roller 2 in a direction toward the photoconductor 1.

With this configuration, the gap adjustment mechanism 42 can control the gap between the photoconductor 1 and the charge roller 2.

Specifically, when adjusting the gap, the shaft positioning member 40 remains contact with the photoconductor 1 and does not rotate with the photoconductor 1. A driving source, not shown, is disposed externally and rotates the shaft positioning member 40 to change its position.

As shown in FIG. 10A, "Da" indicates a longer distance between an outer circumference of the shaft positioning member 40 and a center of the shaft 2*a* of the charge member 2 and "Db" indicates a shorter distance between the outer circumference of the shaft positioning member 40 and the center of the shaft 2*a* of the charge member 2. The charge roller 2 can be positioned with the distance Da as shown in FIG. 10B, and can be positioned with the distance Db as shown in FIG. 10C. The positions can be adjusted to the distances Da and Db by moving the shaft positioning member 40 by a distance for half rotation at a given time and fixing thereafter. For example, to form a gap between the charge roller 2 and the photoconductor 1 to 20 μm and 70 μm, the shaft positioning member 40 may be formed with the distance Da calculated based on an expression of (r+20) and the distance Db calculated based on an expression of (r+20−50), where "r μm" represents a radius of the charge roller 2. With this configuration, by moving the shaft positioning member 40 by a distance corresponding to a half rotation at a desired time, the above-described gaps can be obtained. In this case, the elongate hole provided to change the position of the shaft 2*a* of the shaft positioning member 40 can be easily made by attaching a seal member having a length of 50 μm, for example, to a portion forming the distance Da. Here the external, not-shown drive source drives the charge roller 2.

Next, a description is given of a control of the gap adjustment mechanism 42.

The gap adjustment mechanism 42 forms a large gap or a large charge gap between the photoconductor 1 and the charge roller 2 during an image forming operation or an image outputting operation and forms a narrow gap or a narrow charge gap between the photoconductor 1 and the charge roller 2 during an operation other than image forming operation, such as a driving operation between papers, before or after job, and a power-on operation.

As described above, the gap adjustment mechanism 42 causes to form a large charge gap during an image forming operation. It is because residual toner remaining after transfer during an image forming operation cannot easily contact the charge roller 2 when passing the charge roller 2, thereby reducing or preventing toner adhesion to the charge roller 2. Further, while a conventional charge bias voltage with the DC component can easily cause an uneven charge potential, the charge bias voltage with the AC component superimposed on the DC component can obtain excellent charge uniformity.

As an example of a charge bias voltage used for image forming, the DC component is set to −600V, a peak-to-peak voltage of the AC component is 2 kV, and a sine wave parameter has a frequency of 2.5 kHz. It is desirable that the charge gap is set to 80 μm or smaller. When the charge gap is 100 μm or greater, a discharge inception voltage in Paschen's law becomes greater. This can cause a discharge space larger and increase an amount of discharge product. It is likely that, when the discharge product remains and attaches to the photoconductor 1, time-related deterioration of the photoconductor 1 can be accelerated.

By contrast, under the above-described condition, an amount of toner adhering to the charge roller 2 is small when forming an image. However, since the small amount of toner can accumulate on the charge roller 2 with time, the toner needs to be returned to the photoconductor 1. By narrowing the charge gap when starting an operation other than the image forming operation or image outputting operation, the toner adhering to the charge roller 2 may become closer to the photoconductor 1 in a non-image area where residual toner does not remain on the photoconductor 1. This can increase intense of the electrical field in the charge gap, and can therefore cause the toner adhering to the charge roller 2 to return to the photoconductor 1 more easily. Further, it is more effective that the charge gap is set to zero, that is, it is more effective to contact the charge roller 2 to the photoconductor 1 so as to return a greater amount of toner to the photoconductor 1. Further, if the charge bias voltage is set to a voltage including the DC component, an electrical field can be formed such that toner directs to the photoconductor 1 in one direction, which can increase an efficiency to return the toner to the photoconductor 1.

Consequently, a cleaning mode is provided to clean the charge roller 2 at a time other than the image forming. In the cleaning mode, the gap formed between the charge roller 2 and the photoconductor 1 is narrowed to return the toner adhering to the charge roller 2 back to the photoconductor 1 for a given period of time. The cleaning mode can then surely clean the charge roller 2. Further, an amount of toner accumulating on the charge roller 2 can be reduced. Therefore, contamination of the charge roller 2 can be reduced, the uniform charge can be achieved over an extended period of time, and stable image quality can be obtained. Further, good reliability and extended life of the image forming apparatus 100 can be attained.

As an example, the DC bias voltage is set to −1200V. Toner adhering to the surface of the charge roller 2 may not be charged to its regular amount but may be weak or reverse. However, if the toner is charged weakly or reversely, the toner can be repeatedly passed or tossed in the charge gap where a strong electrical field is formed. By so doing, the toner can receive electrical charge injection to obtain the regular amount thereof, and can return to the photoconductor 1 as a result. Therefore, when performing a driving operation other than this image output, the charge gap is caused to narrow for a predetermined or given period in a different cleaning mode to return toner to the photoconductor 1, thereby cleaning the charge roller 2 sufficiently.

As described above, the image forming apparatus 100 according to an exemplary embodiment includes the charge roller 2 and the photoconductor 1 disposed facing in a non-contacting manner to apply a voltage including the AC component. With this construction, the charge roller 2 cleans itself to hinder toner adhesion to the charge roller 2. Further, before residual toner remaining on the photoconductor 1 passes the charge roller 2, the toner spreading member 5 can spread residual toner by transferring the residual toner from a portion of the photoconductor 1 where a large amount of residual toner remains onto a portion of the photoconductor 1 with a small amount of residual toner. By so doing, the residual toner can be weakly charged evenly by the charge roller 2, which can enhance toner collection by the developing unit 4 to prevent a residual image.

Further, in the image forming apparatus 100 according to an exemplary embodiment of the present invention, the toner spreading member 5 collects toner by performing toner collection in the image forming region and discharges the toner by performing toner discharge in the non-image forming region. Therefore, residual toner remaining on a portion of the photoconductor 1 where a large amount of residual toner remains can be transferred onto a portion of the photoconductor 1 with a small amount of residual toner. By so doing, the residual toner can be weakly charged evenly by the charge roller 2, which can prevent a residual image. Even when the residual toner appears on the non-image forming region, the residual image may not adversely affect on an output image.

Further, in the image forming apparatus 100 according to an exemplary embodiment of the present invention, toner collection is performed in an image area of the photoconductor 1 and toner discharge is performed in a non-image area of the photoconductor 1. Therefore, residual toner remaining on a portion of the photoconductor 1 where a large amount of residual toner remains can be transferred onto a portion of the photoconductor 1 with a small amount of residual toner. By so doing, the residual toner can be weakly charged evenly by the charge roller 2, which can prevent a residual image.

Further, in the image forming apparatus 100 according to an exemplary embodiment of the present invention, a potential difference between an electric potential of the direct current component of the voltage applied to the toner spreading member 5 and an electric potential of the photoconductor 1 during toner collection performed in the image forming region or in the image area is different from the potential difference between the electric potential of the direct current component of the voltage applied to the toner spreading member 5 and the electric potential of the photoconductor 1 during toner discharge performed in the non-image forming region or in the non-image area. This can effectively control toner collection performed in the image forming region or in the image area and toner discharge performed in the non-image forming region or in the non-image area.

Further, in the image forming apparatus 100 according to an exemplary embodiment of the present invention, when the electrical charge distribution of the residual toner is moved to a negative polarity side, the direct current component of the voltage applied to the toner spreading member 5 is greater during toner collection performed in the image forming region or in the image area than during toner discharge performed in the non-image forming region or in the non-image area. Further, the electrical charge distribution of the residual toner is moved to a positive polarity side, the direct current component of the voltage applied to the toner spreading member 5 is smaller during toner collection performed in the image forming region or in the image area than during toner discharge performed in the non-image forming region or in the non-image area. Therefore, the electric potential in toner collection performed in the image forming region or in the image area and the electric potential in toner discharge performed in the non-image forming region or in the non-image area can be different. This can effectively control toner collection in the image forming region or in the image area and toner discharge in the non-image forming region or in the non-image area.

Further, in the image forming apparatus 100 according to an exemplary embodiment of the present invention, a frequency of an alternating current component of a voltage applied to the toner spreading member 5 during toner collection performed in the image forming region or in the image area is different from a frequency of an alternating current component of a voltage applied to the toner spreading member during toner discharge performed in the non-image forming region or in the non-image area. This can effectively control toner collection in the image forming region or in the image area and toner discharge in the non-image forming region or in the non-image area.

Further, in the image forming apparatus 100 according to an exemplary embodiment of the present invention, a voltage applied to the toner spreading member 5 includes only a direct current component during toner collection in the image forming region or in the image area and includes a direct current component and an alternating current component superimposed on a direct current component during toner discharge in the non-image forming region or in the non-image area. That is, toner discharge can be performed more easily to use the direct current component and an alternating current component superimposed on a direct current component.

Further, in the image forming apparatus 100 according to an exemplary embodiment of the present invention, a voltage applied to the toner spreading member 5 includes an alternating current component superimposed on a direct current both in toner collection in the image forming region or in the image area and in toner discharge in the non-image forming region or in the non-image area, and a frequency of the alternating current component of the voltage applied to the toner spreading member 5 during toner collection in the image forming region or in the image area is greater than a frequency of the alternating current component of the voltage applied to the toner spreading member during toner discharge in the non-image forming region or in the non-image area. That is, the residual toner can be discharged from the toner spreading member 5 more easily when an application bias having a low frequency AC component is applied than when an application bias having a high frequency AC component is applied.

Further, in the image forming apparatus 100 according to an exemplary embodiment of the present invention, the toner spreading member 5 contacts the photoconductor 1 with a first contact pressure during toner collection in the image forming region or in the image area and with a second contact pressure different from the first contact pressure during toner discharge in the non-image forming region or in the non-image area. This can effectively control toner collection in the image forming region or in the image area and toner discharge in the non-image forming region or in the non-image area.

Further, in the image forming apparatus 100 according to an exemplary embodiment of the present invention, the first contact pressure of the toner spreading member 5 against the photoconductor 1 during toner collection in the image forming region or in the image area is greater than the second contact pressure of the toner spreading member against the image carrier during toner discharge in the non-image forming region or in the non-image area. The greater the contact pressure of the toner spreading member 5 against the photoconductor is, the higher the toner collection performance can be. By contrast, the smaller the contact pressure of the toner spreading member 5 against the photoconductor is, the higher toner discharge performance can be.

Further, the toner spreading brush roller 5D in the image forming apparatus 100 according to an exemplary embodiment of the present invention is a rotary member and rotates at a first speed of rotation during toner collection and at a second speed of rotation different from the first speed of rotation during toner discharge. This can effectively control toner collection in the image forming region or in the image area and toner discharge in the non-image forming region or in the non-image area.

Further, in the image forming apparatus 100 according to an exemplary embodiment of the present invention, the velocity difference between the linear velocity of the toner spreading brush roller 5D and the linear velocity of the photoconductor 1 during toner discharge in the non-image forming region or in the non-image area is greater than the velocity difference between the linear velocity of the toner spreading brush roller 5D and the linear velocity of the photoconductor 1 during toner collection in the image forming region or in the image area. The smaller the velocity difference of the linear velocity of the toner spreading brush roller 5D and the linear velocity of the photoconductor 1 is, the higher the toner collection performance can be. By contrast, the greater the velocity difference between the linear velocity of the toner spreading brush roller 5D and the linear velocity of the photoconductor 1 is, the higher the toner discharge performance can be.

Further, the toner spreading member 5 of the image forming apparatus 100 according to an exemplary embodiment of the present invention can be the toner spreading brush 5A and the toner spreading brush roller 5D. The toner spreading brush 5A can provide parameters, for example, application bias and contact pressure, and can easily control the toner collection and the toner discharge. The toner spreading brush roller 5D allocate all parameters such as a speed of rotation, an application bias, and a contact pressure, so that toner collection and the toner discharge can be controlled easily.

Further, the toner spreading member 5 of the image forming apparatus 100 according to an exemplary embodiment of the present invention can be the toner spreading blade 5B that is inexpensive and can contribute to low cost.

Further, the toner spreading member 5 of the image forming apparatus 100 according to an exemplary embodiment of the present invention can be the toner spreading roller 5C that can hinder changes in an amount of toner collection and in amount of toner discharge over time.

Further, the toner spreading roller 5C in the image forming apparatus 100 according to an exemplary embodiment of the present invention is disposed facing the photoconductor 1 across a gap. With this configuration, the toner spreading roller 5C can prevent the photoconductor 1 from fixed adhesion of foreign material such as toner.

Further, in the image forming apparatus 100 according to an exemplary embodiment of the present invention, the toner spreading brush 5A or the toner spreading blade 5B are slidably movable in a longitudinal direction thereof, which can increase the effectiveness of spreading toner in the longitudinal direction of the toner spreading brush 5A or the toner spreading blade 5B.

Further, in the above-described image forming apparatus according to an exemplary embodiment, the charge gap is controlled to clean the charge roller 2 before outputting an image. For example, in a conventional cleaner-less system employing a fixed charge gap, a charge roller is replaced with a new one after outputting approximately 30,000 sheets of paper to avoid defects in images due to contamination of the charge roller 2. By contrast, in the cleaner-less system employed in the image forming apparatus 100 according to an exemplary embodiment of the present invention, the charge gap is controlled to clean the charge roller 2. As a result, no defective image is produced with the same charge roller 2 even after outputting 50,000 sheets of paper. Accordingly, it has been proved that the charge roller 2 can be used for extending the service time of the image forming apparatus 100 according to an exemplary embodiment of the present invention.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image carrier to carry an image thereon;

a charging unit disposed in a vicinity of the image carrier to charge the image carrier, the charging unit including a charge member facing the image carrier across a gap therebetween, the charge member charging the image carrier using electrical discharge caused by applying thereto a voltage including an alternating current component superimposed on a direct current component;

a latent image forming unit disposed in a vicinity of the image carrier to form a latent image on the image carrier;

a developing unit disposed in a vicinity of the image carrier to supply toner for developing the latent image formed on the image carrier into a toner image and to collect residual toner remaining on the image carrier;

a transfer unit disposed in a vicinity of the image carrier to transfer a toner image formed on the image carrier onto a recording medium; and a toner spreading member to spread toner on the image carrier, disposed upstream from the charging unit in a direction of movement of the image carrier and downstream from the transfer unit in the direction of movement of the image carrier, wherein the toner spreading member contacts the image carrier with a first contact pressure during toner collection and with a second contact pressure different from the first contact pressure during toner discharge.

2. The image forming apparatus according to claim 1, wherein the toner spreading member spreads toner by performing toner collection by collecting at least a part of residual toner and by performing toner discharge by discharging at least a part of collected toner.

3. The image forming apparatus according to claim 2, wherein toner collection is performed in an image forming region of the image carrier and toner discharge is performed in a non-image forming region of the image carrier.

4. The image forming apparatus according to claim 2, wherein toner collection is performed in an image area of the image carrier and toner discharge is performed in a non-image area of the image carrier.

5. The image forming apparatus according to claim 2, wherein a potential difference between an electric potential of a direct current component of a voltage applied to the toner spreading member and an electric potential of the image carrier during toner collection is different from an electric potential difference between the electric potential of the direct current component of the voltage applied to the toner spreading member and the electric potential of the image carrier during toner discharge.

6. The image forming apparatus according to claim 5, wherein:

when electrical charge distribution of the residual toner is moved to a negative polarity side, the direct current component of the voltage applied to the toner spreading member is greater during toner collection than during toner discharge, and when the electrical charge distribution of the residual toner is moved to a positive polarity side, the direct current component of the voltage applied to the toner spreading member is smaller during toner collection than during toner discharge.

7. The image forming apparatus according to claim 1, wherein a frequency of an alternating current component of a voltage applied to the toner spreading member during toner collection is different from a frequency of an alternating current component of a voltage applied to the toner spreading member during toner discharge.

8. The image forming apparatus according to claim 1, wherein a voltage applied to the toner spreading member includes only a direct current component during toner collection and includes a direct current component and an alternating current component superimposed on a direct current component during toner discharge.

9. The image forming apparatus according to claim 1, wherein a voltage applied to the toner spreading member includes an alternating current component superimposed on a direct current component both in toner collection and in toner discharge, and a frequency of the alternating current component of the voltage applied to the toner spreading member during toner collection is greater than a frequency of the alternating current component of the voltage applied to the toner spreading member during toner discharge.

10. The image forming apparatus according to claim 1, wherein the first contact pressure of the toner spreading member against the image carrier during toner collection is greater than the second contact pressure of the toner spreading member against the image carrier during toner discharge.

11. The image forming apparatus according to claim 1, wherein the toner spreading member is a rotary member, and rotates at a first speed of rotation during toner collection and at a second speed of rotation different from the first speed of rotation during toner discharge.

12. The image forming apparatus according to claim 11, wherein a velocity difference between a linear velocity of the toner spreading member and a linear velocity of the image carrier during toner discharge is greater than a velocity difference between a linear velocity of the toner spreading member and a linear velocity of the image carrier during toner collection.

13. The image forming apparatus according to claim 1, wherein the toner spreading member is a brush member.

14. The image forming apparatus according to claim 13, wherein the toner spreading member is slidably movable in a longitudinal direction thereof.

15. The image forming apparatus according to claim 1, wherein the toner spreading member is a blade member.

16. The image forming apparatus according to claim 1, wherein the toner spreading member is a roller member.

17. The image forming apparatus according to claim 16, wherein the toner spreading member is a roller member disposed facing the image carrier across a gap.

18. The image forming apparatus according to claim 1, wherein the developing unit serves as a cleaning unit by collecting the residual toner remaining on the image carrier, and the image forming apparatus further comprises a gap adjustment mechanism disposed at least one end of the charge member to adjust a gap between the charging unit and the image carrier.

19. An image forming apparatus, comprising:

an image carrier to carry an image thereon;

a charging unit disposed in a vicinity of the image carrier to charge the image carrier, the charging unit including a charge member facing the image carrier across a gap therebetween, the charge member charging the image carrier using electrical discharge caused by applying thereto a voltage including an alternating current component superimposed on a direct current component;

a latent image forming unit disposed in a vicinity of the image carrier to form a latent image on the image carrier;

a developing unit disposed in a vicinity of the image carrier to supply toner for developing the latent image formed on the image carrier into a toner image and to collect residual toner remaining on the image carrier;

a transfer unit disposed in a vicinity of the image carrier to transfer a toner image formed on the image carrier onto a recording medium; and a toner spreading member to spread toner on the image carrier, disposed upstream from the charging unit in a direction of movement of the image carrier and downstream from the transfer unit in the direction of movement of the image carrier, wherein a frequency of an alternating current component of a voltage applied to the toner spreading member during toner collection is different from a frequency of an alternating current component of a voltage applied to the toner spreading member during toner discharge.

* * * * *